United States Patent [19]

Skaggs

[11] Patent Number: 4,687,075

[45] Date of Patent: Aug. 18, 1987

[54] LOCKING SAFETY PLATFORM FOR A LADDER

[76] Inventor: Jerry W. Skaggs, P.O. Box 67, Malden, W. Va. 25306

[21] Appl. No.: 14,857

[22] Filed: Feb. 13, 1987

[51] Int. Cl.[4] ..... E06C 7/16

[52] U.S. Cl. ..... 182/121; 248/238

[58] Field of Search ..... 182/121, 120, 122; 248/238

[56] References Cited

U.S. PATENT DOCUMENTS

| | | | |
|---|---|---|---|
| 363,483 | 5/1887 | Ramsey | 182/121 |
| 745,750 | 12/1903 | Ziegler et al. | 182/121 |
| 1,920,552 | 8/1933 | Dollerhide | 182/121 |
| 2,104,987 | 1/1938 | Harding | 182/121 |
| 2,500,559 | 3/1950 | Miller | 182/121 |
| 3,511,338 | 5/1970 | Chapman | 182/121 |
| 3,899,045 | 8/1975 | Geisel | 182/121 |
| 4,482,030 | 11/1984 | Lincourt | 248/238 |
| 4,496,025 | 1/1985 | Gattman | 182/121 |
| 4,646,878 | 3/1987 | Moyer | 248/238 |

FOREIGN PATENT DOCUMENTS

| | | | |
|---|---|---|---|
| 2036152 | 6/1980 | United Kingdom | 182/121 |

*Primary Examiner*—Reinaldo P. Machado
*Attorney, Agent, or Firm*—Richard C. Litman

[57] ABSTRACT

This invention relates to an improved safety platform for attachment to a ladder. The locking means of the device is engaged and disengaged without the use of tools or complicated mechanical means. This enables the user to adjust the height of the attachment on the ladder while standing on the ladder above ground level. The platform of the invention is fixed in a generally horizontal plane to hold containers or like articles, or for use as a platform for a person to stand upon while working. The invention is ideally suited for use by painters and like persons who do exacting work at varying heights above ground level while standing on a ladder.

7 Claims, 4 Drawing Figures

LOCKING SAFETY PLATFORM FOR A LADDER

BACKGROUND OF INVENTION

1. Field of Invention

The invention relates to an attachment for a ladder, and more particularly, the invention is directed to an improved detachable platform which can easily be locked into position for use by painters and other laborers who require stable footing when working while standing on a ladder, especially when the work requires the laborer to stand on the platform for extended periods of time and at varying heights above ground level during the work activity.

The invention further relates to an improved safety feature for ladder attachments which provides for locking the platform to the ladder. More particularly, the invention is directed to providing a mechanism for the attachment of the platform in a secure, fixed position, without the use of tools or complicated mechanical measures, which can be accomplished while the laborer is standing on a ladder rung at heights above ground level. The device, in its locked position, would fix the platform in a generally horizontal plane, enabling the laborer to have stable footing thereon, without any obstruction from the ladder attachment. The device can also be used to place containers or articles thereon for the laborer's use over extended periods of time. The invention is particularly suited for use by painters and other types of laborers who during the course of their work activity have to constantly adjust their height from ground level, yet require stable footing while accomplishing exacting work.

The invention can be used for a variety of applications, and the method of construction of the device is more fully described herein.

2. Description of the Prior Art

Various prior art ladder attachment devices and ladders, and the like, as well as their apparatuses and the method of their construction in general, are known and are found to be exemplary of the U.S. prior art. They are:

| Inventor | U.S. Pat. No. |
|---|---|
| B. H. Ziegler and D. Betzner | 745,750 |
| C. M. Dollerhide | 1,920,552 |
| K. C. Miller | 2,500,559 |
| E. H. Chapman | 3,511,338 |
| W. R. Lincourt | 4,482,030 |

The Lincourt patent is for a safety platform which has L-shaped hooks used for attachment to the upper and lower rungs. Dollerhide shows a detachable ladder step secured to two rungs of the ladder; U-shaped hooks are used for securing the invention to the upper rung. Chapman's invention also utilizes U-shaped brackets, but uses them to secure the device to the lower rung; steel hooks secure the stand to the upper rung. This invention is particularly suited for supporting one end of a plank which at its opposite end is supported by a like ladder stand upon a ladder.

The Miller patent is directed to a ladder platform wherein the base is pivotably secured to one rung and swinging hook means are adjustable to various positions by means of notched formations in the side flanges of the platform.

Ziegler and Betzner disclose an extension ladder with a moveable and adjustable shelf which is also secured in place by hooks projecting from the shelf to two rungs of the ladder. The extension feature of the ladder employs a bracing mechanism to secure the extended ladder in its adjusted position; steel wires are drawn taut by means of nuts on the ends of bolts to the required tension for the purpose of forming a truss.

These patents or known prior uses teach and disclose various types of ladders and ladder attachment devices of sorts and of various manufactures, and the like, as well as methods of their construction; but none of them, whether taken singly or in combination, disclose the specific details of the combination of the invention in such a way as to bear upon the claims of the present invention.

SUMMARY OF THE INVENTION

An object, advantage, and feature of the invention is to provide a novel ladder attachment that is safe and efficient in use, providing its user with a stable platform fixed at a generally horizontal plane for placement of containers or like articles, or, more especially, for use as a platform to stand upon while working at heights above ground level.

Another object of the invention is directed further to a device providing for the easy locking of the attachment device into a desired position on the rungs of a ladder, and the easy removal thereof, without tools or complicated mechanical measures, while the user is standing on the ladder above ground level. This is a substantial improvement over existing devices whereby various types of hook assemblies or other convoluted means are utilized to suspend the ladder attachment on the ladder rungs.

Another object of the invention is to provide a novel and improved construction of securing a ladder attachment, to wit, the employment of hinged, arcuate safety bracket members which are engaged to both the upper rung of a ladder as well as to support members attached to the rear of the platform and extending to the upper rung of the ladder.

Another object of the invention is to provide a novel and improved method of construction of a ladder attachment whereby a locking mechanism is incorporated therein, allowing for the required stability essential for supporting a person at heights above ground level, and enabling said person to remove and reengage the attachment to different rungs of the ladder if needed to perform the desired work activity.

These, together with other objects and advantages of the invention, reside in the details of the process and the operation thereof, as is more fully hereinafter described and claimed. References are made to drawings forming a part hereof, wherein like numerals refer to like parts throughout.

DESCRIPTION OF THE PREFERRED EMBODIMENT(S) OF THE INVENTION

Figure 1:
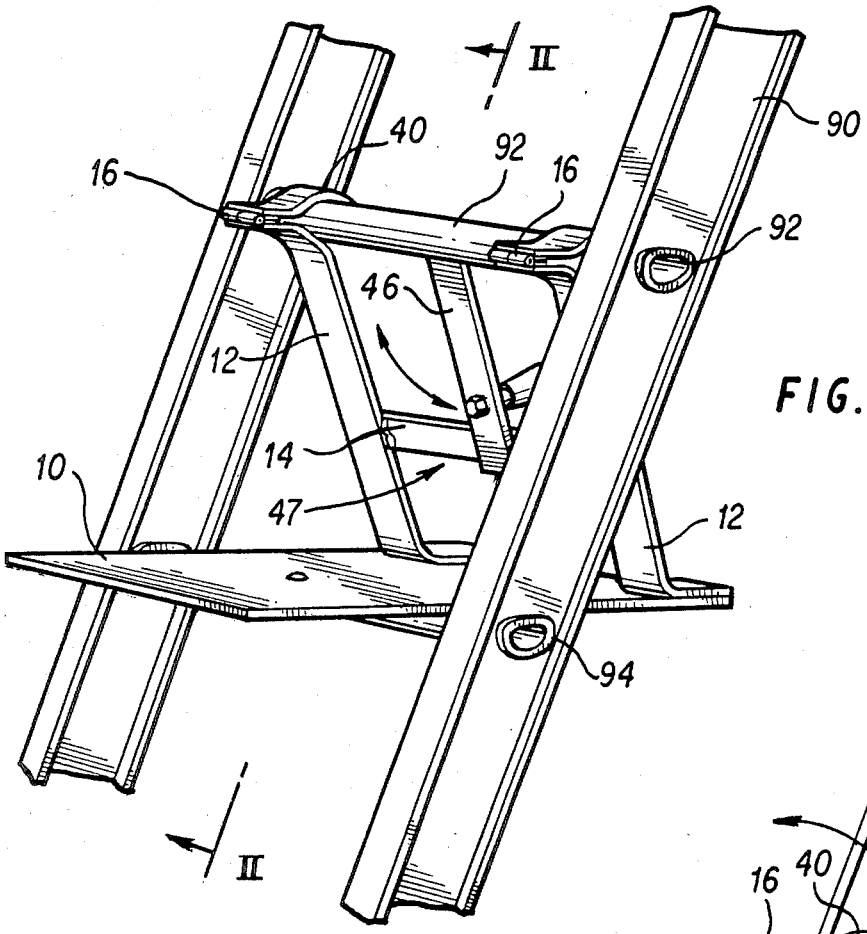
FIG. 1 is a three-quarters perspective view of the locking safety platform, illustrating a typical construction of the device according to a preferred embodiment and best mode of the present invention.

Referring now to the drawings, there is shown in FIG. 1 the locking safety platform secured to two rungs of a ladder 90, said rungs are upper rung 92 and lower rung 94. Foot platform 10 is supported on lower rung 94 in a horizontal position.

Figure 2:
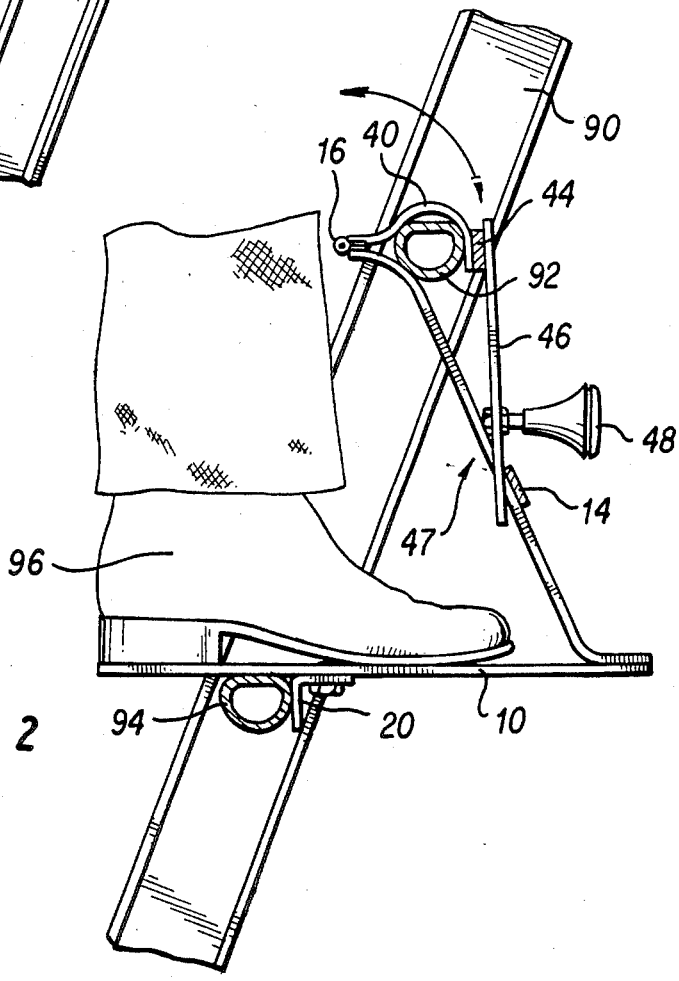
FIG. 2 is a sectional view taken across the line II—II of FIG. 1, of the locking safety platform, in its locked position.

As shown in FIG. 2, platform 10 has stop 20 on the bottom thereof to prevent forward movement when weight is applied to the platform; the force of gravity causes stop 20 into engagement with the lower rung 94. Support brackets 12 are attached to the rear of the said platform 10 at the sides thereof and extend at an acute angle to the proximate front midpoint of the next higher rung of the ladder, the upper rung 92. A horizontal cross-brace 14 connects the support brackets at the proximate midpoints thereof. Support brackets 12 terminate in a horizontal plane at hinge member 16.

Figure 3:
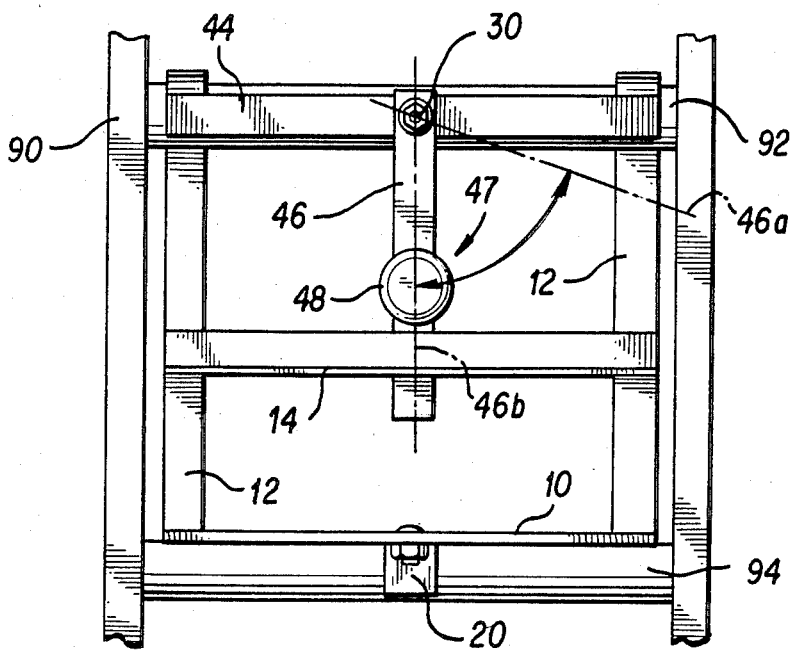
FIG. 3 is a rear orthographic view of the device, showing the pivoting action of the securing arm.

FIG. 3 shows arcuate support members 40 attached to said hinged members 16 for engagement with the upper rung 92 of ladder 90. Each of the arcuate support members 40 terminate in a vertical leg 42.

Figure 4:
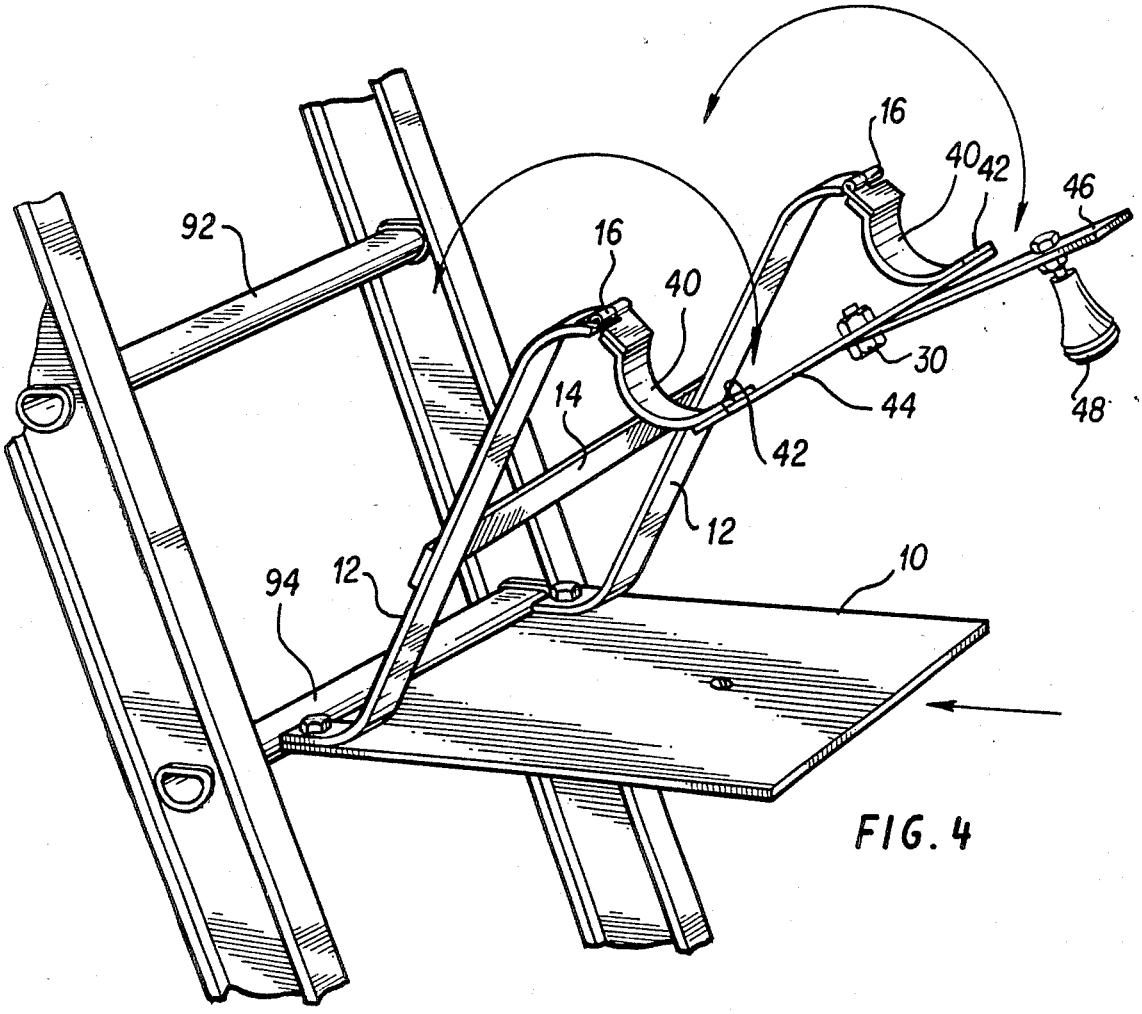
FIG. 4 is a three-quarters perspective view showing the platform prior to its attachment to the ladder.

As shown in FIG. 4, a cross-member 44 is attached to the vertical legs 42 so that the hinge members 16 operate together. A securing or locking arm 46 is attached by pivoting means 30, such as a nut and bolt assembly, at the midpoint of said cross-member 44, for engagement with the front of the cross-brace 14 connecting the support brackets 12 and forming locking means 47. The locking arm 46 has rearward spring action so that force is required to move it forward to clear the cross-brace 14 before the locking arm 46 can be moved into a vertical position for engagement with the cross-brace 14. Knob 48 is attached near the proximate end of locking arm 46 to provide easy gripping means for the user in moving locking arm 46 from the release position, 46*a* to the locked position, indicated by central axis 46*b*. In securing locking means 47 in such a manner, the ladder safety platform is in a fixed, stable position, and said foot platform 10 is at a generally horizontal plane.

In operation, the user would climb ladder 90 to a height a few rungs below the desired height required to perform the intended work activity. The ladder safety platform, which can be fabricated of metal or other rigid, weight bearing, durable material, including plastic, can be easily carried by the user up the ladder by means of knob 48 or cross-brace 14.

The user then places the invention on the upper and lower rungs as previously described in a fixed position. No tools or complicated mechanical measures are required for this procedure. The user then places articles, such as tools or paint containers, on foot platform 10 for use in the work activity, or uses the platform 10 to stand upon for performance of the work activity. Platform 10 can have a smooth surface, or, if desired, a rough surface to provide more friction between the user's foot 96 and platform 10, so as to prevent the user from slipping therefrom. Hinge members 16 and/or support brackets 12 can be padded so as to prevent injury to the user's leg or damage to the user's clothing from contact with the invention.

Once the user has completed the work activity, he can reverse the above-described procedure to disengage the safety platform and either ascend or descend the ladder 90 to a different position on said ladder. At this height the user can engage the platform for work activity at this height above ground level. Or the user can disengage the safety platform and descend to ground level.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to, fall within the scope of the invention.

What is claimed is:

1. A safety platform for attachment to a ladder comprising:

a foot platform supported by one rung of a ladder in a horizontal position, said platform having a leveling means on the bottom thereof to prevent forward movement when weight is applied to the platform;

support brackets attached to the rear of said platform at the sides thereof and extending at an acute angle to the proximate front midpoint of the next higher rung of the ladder, said brackets terminating in a horizontal plane;

a horizontal cross-brace connecting the support brackets at the proximate midpoints thereof;

hinge members at each upper end of the support brackets;

arcuate support members attached to said hinge members for engagement with the upper rung of the ladder, each of said arcuate support members terminating in a vertical leg;

a cross-member attached to the vertical legs of said support members so that the hinge members operate together;

a locking arm pivotably attached at the midpoint of said cross-member for engagement with the front of the cross-brace connecting the support brackets, said locking arm having a rearward spring action so that force is required to move it forward to clear the cross-brace before the locking arm can be moved into a vertical position for engagement with the cross-brace.

2. A safety platform for a ladder as described in claim 1, wherein the leveling means on the bottom of said platform engage with the lower rung of the ladder when weight is applied to the platform.

3. A safety platform for a ladder as described in claim 2, wherein the leveling means are one or more stops.

4. A safety platform as described in claim 1, further including a knob attached to the proximate end of said locking arm to facilitate the securing of the locking arm into a vertical position.

5. A safety platform as described in claim 1, further including padding on said hinge members.

6. A safety platform as described in claim 1, further including padding on said arcuate support members.

7. A safety platform as described in claim 1, wherein the foot platform has a rough surface.

* * * * *